US007861619B2

(12) United States Patent
Stensland

(10) Patent No.: US 7,861,619 B2
(45) Date of Patent: Jan. 4, 2011

(54) POWER TONG

(75) Inventor: Eivind Gimming Stensland, Kristiansand (NO)

(73) Assignee: Aker Kvaerner MH AS, Kristiansand (NO)

( * ) Notice: Subject to any disclaimer, the term of this patent is extended or adjusted under 35 U.S.C. 154(b) by 223 days.

(21) Appl. No.: 12/303,185

(22) PCT Filed: Jun. 8, 2007

(86) PCT No.: PCT/NO2007/000199

§ 371 (c)(1),
(2), (4) Date: Dec. 2, 2008

(87) PCT Pub. No.: WO2007/142535

PCT Pub. Date: Dec. 13, 2007

(65) Prior Publication Data

US 2009/0235786 A1 Sep. 24, 2009

(30) Foreign Application Priority Data

Jun. 9, 2006 (NO) ..... 20062669

(51) Int. Cl.
*B25B 13/50* (2006.01)
*E21B 19/16* (2006.01)

(52) U.S. Cl. ..... 81/57.16; 81/57.34; 81/57.35

(58) Field of Classification Search ..... 81/57.24, 81/57.33, 57.34, 57.35, 57.36
See application file for complete search history.

(56) References Cited

U.S. PATENT DOCUMENTS 5,081,888 A 1/1992 Schulze-Beckinghausen
5,161,438 A * 11/1992 Pietras ..... 81/57.16
5,259,275 A * 11/1993 Schulze-Beckinghausen ..... 81/57.16
5,390,568 A 2/1995 Pietras
2004/0195555 A1 10/2004 Bangert et al.

FOREIGN PATENT DOCUMENTS

EP 1 559 865 8/2005
WO WO 02/00395 1/2002

OTHER PUBLICATIONS

International Search Report for PCT/NO2007/000199, mailed Sep. 11, 2007.
Written Opinion of the International Searching Authority for PCT/NO2007/000199, mailed Sep. 11, 2007.
Norwegian Search Report for NO Application No. 20062669, dated Jun. 7, 2007.

* cited by examiner

*Primary Examiner*—David B Thomas
(74) *Attorney, Agent, or Firm*—Nixon & Vanderhye PC

(57) ABSTRACT

A power tong construction in particular designed to annul compulsory forces that may arise within the tong construction during makeup/breakout operations of pipe joints in a string of pipes, is shown. The power tong construction is one unit having a main frame carrying a torque tong and a backup tong. The main frame is located on a drill floor on board a vessel or fixed installation, and is moveably arranged in guide rails. The torque tong is loosely suspended and "floatingly" arranged in the power tong construction, said power tong thereby having a limited freedom of motion in all directions in the horizontal plane and vertical plane, and has means to counteract external rotation and annulment of compulsory forces, when the power tong makes up/breaks out pipe joints, arranged between the power tong and the main frame.

8 Claims, 4 Drawing Sheets

POWER TONG

This application is the U.S. national phase of International Application No. PCT/NO2007/000199, filed 8 Jun. 2007, which designated the U.S. and claims priority to Norway Application No. 20062669, filed 9 Jun. 2006, the entire contents of each of which are hereby incorporated by reference.

The present invention relates to a power tong construction, in particular designed to annul compulsory forces that may arise within the tong construction during makeup/breakout operations of pipe joints in a string of pipes, said power tong being constructed as one unit having a main frame carrying a torque tong and a backup tong, said main frame being normally located on a drill floor on board a floating vessel or onto a fixed installation, and is moveably arranged in guide rails on the drill floor.

Roughly described such a power tong construction normally consists of a backup tong, a torque tong and usually, but not strictly necessary, a spinner tong. All tongs are assembled into a unit that can be translated along a substratum, such as a drill floor on board a rig or a drilling vessel. The backup tong is located lowermost in the unit, closest to the substratum and is designed to enclose the upper end of a tubular, such as a drill pipe or casing. The upper end of the tubular normally has an internal threaded portion and is often described as the female part of a pipe joint. The backup tong is able to grip around the pipe by means of gripping jaws and maintains the pipe against rotation.

The torque tong is located above the backup tong. The torque tong is also able to grip around a pipe close to a pipe joint, normally the lower end of a pipe that is vertically suspending. The lower end of the tubular usually has a portion with external threads and is often described as the male part of a pipe joint. The torque tong grips the pipe with gripping jaws and fixes the pipe, at the same time as the tong is able to perform rotation of the pipe for making up a predetermined torque, alternatively breaking out the pipe joint during an unthreading operation.

The spinner tong is in turn located above the torque tong and is primarily used to perform quick threading of the male part into the female part. The spinner tong usually has three rollers with frictional surfaces engaged with the tubular somewhat above the pipe joint and the male part. When the external threads on the male part have entered the internal threads within the female part, the pipe forced into rotation by the spinner tong via the rollers for quick threading of the male part into the female part that is stationary fixed by the backup tong. When the male threaded portion has completed the threading in by the spinner tong, the torque tong will take over and makes up correct predetermined torque within the pipe joint.

The background for the present invention is the need to resolve the problem about compulsory forces that arises between a backup tong and a torque tong during make up or break out of pipe joints between drill pipes or casings. Such compulsory forces can also arise between tongs and the drill floor or a guide frame fixed to a drill floor.

The reasons to why such compulsory forces can arise are obliquity in alignment of drill pipes, tolerances of tubulars, movement of pipes due to flow forces or displacement of the rig.

Compulsory forces will in turn load the tong construction at the same time as it will influence on the torque measurement and have an adverse effect on the threads of the casings/drill pipes. Today it is a considerable loss of casings on drilling rigs due to damaged threads.

Till today it has been usual to suspend the backup tong and the torque tong in chains in a "loose" connection, such that compulsory forces can not arise between the respective tongs and/or drill floor.

The above described way to resolve the problem do per se function, but it provides a disadvantageous large construction for automated torque tongs that are translated horizontally on a rail arrangement.

One object with the present invention is in an easy way to let the torque tong be able to "float" freely in the plane relative to a guide frame fixed to the drill floor and at the same time be able to pick up-torque in a precise and prompt way without the tong being displaced because of the torque load.

In the market today a variety of power tong constructions exist that does not resolve the above described problems in a smooth way. The present tong construction is based on the applicants own prior solution which is described in detail in Norwegian Patent NO 318187 (WO 004/076805) and NO 319959 (WO 2004/076806) which hereby is included as reference. The detailed construction of the respective tongs within the tong construction is regarded as known through these publications and will not be described in detail here. It is to be understood that the present invention nevertheless can be adapted and used on other power tong constructions than those who are referred to in the publications above. Other examples of the prior art are U.S. Pat. Nos. 5,390,568; 4,972,741; US 2004/0195555 A1; EP 1 559 865 A2 and WO 02/00395 A1.

Further older, prior art and the problems around compulsory forces in torque tongs are illuminated in U.S. Pat. No. 4,972,741. In this it is again referred to a series of older patent publications which represent the prior art.

According to the present invention a power tong construction of the introductory said kind is provided, which is distinguished in that the torque tong is loosely suspended and "floatingly" arranged in the power tong construction, said power tong thereby having a limited freedom of motion in all directions in the horizontal plane and vertical plane, and that means to counteract external rotation and annulment of compulsory forces, when the power tong makes up/breaks out pipe joints, is arranged between the power tong and the main frame. This describes the simplest embodiment of the power tong construction according to the invention. This is defined without the spinner tong and without a trolley or "dolly" that the torque tong is designed to be suspended from. In stead the torque tong is suspended directly from cantilevers from the main frame.

Preferably the means to counteract external rotation and annulment of compulsory forces comprises at least a pair of working cylinders articulated secured in each end to the torque tong and the main frame respectively, and the working cylinders are in fluid communication with each other via cross-connected pipe connections.

Each working cylinder can include an internal piston having the same area on each side, and a through running piston rod.

The means to counteract external rotation can further include a dolly, said dolly being vertically displaceable along the main frame. The working cylinders are in turn articulately secured in each end to the torque tong and the dolly respectively.

In the illustrated embodiment the "loose" suspension of the torque tong takes place by means of a number of chains depending down from the main frame/trolley and provide degrees of freedom in the tong plane.

Preferably the working cylinders form a force couple during a making up operation; the working cylinders include load bolts that are able to provide a signal indicative for the applied torque by the torque tong.

In a preferred embodiment, the tong construction further comprises a spinner tong located above the torque tong.

In a further preferred tong construction, the spinner tong is mounted on the torque tong and is displaced together therewith.

In a more preferred tong construction, the spinner tong is mounted to an auxiliary frame which in turn is mounted to the torque tong, and the spinner tong is in turn independent adjustable in height relative to the torque tong.

In a suitable embodiment the power tong construction can include a guide funnel that is displaceable in and out of position to guide a pipe end having a male part into a pipe end having a female part.

Other and further objects, features and advantages will appear from the following description of a preferred embodiment of the invention, which is given for the purpose of description, and given in context with the appended drawings where:

FIG. 1 shows in perspective view a power tong construction according to the present invention, FIG. 2 shows an elevated side view of the power tong construction according to FIG. 1, with the respective tongs in different elevations, FIG. 3 shows in perspective view a main frame for the power tong construction according to FIG. 1, FIG. 4 shows in perspective view a dolly designed to carry the torque tong in the power tong construction according to the invention, FIG. 5 shows a schematic representation of the power tong construction viewed from the side, FIG. 6A shows schematically a working cylinder having load bolts, and FIG. 6B shows schematically two cross-connected working cylinders.

Reference is firstly made to FIG. 1 that shows the complete power tong construction 10 obliquely from the front and in perspective view. The power tong construction is a compound unit consisting of two or more tongs. The shown embodiment consists of a backup tong 1, a torque tong 2 and one spinner tong 3. The spinner tong 3 is not strictly necessary, but is preferred in order to speed up the operations that are performed. The respective tongs are in turn mounted to a main frame 4 that can be translated along a substratum such as a drill floor on board a rig, a drill ship or a fixed installation. The main frame has a number of wheel sets 5 that cooperate with rails (not shown) that are fixedly mounted to the substratum or the drill floor. In that way the entire power tong construction 10 can be translated along the rails towards a well centre on the drill floor in order to make up connections of pipe sections, alternatively perform break out and disassembly. When the tong construction 10 has performed its task, the tong is displaced along the rails away from the well centre and is parked while other operations are ongoing, like well drilling.

The detailed construction of the respective tongs in the tong construction 10 is considered as known by the person skilled in the art through the above referred publications and will not be described in detail here. Only a rough description of the known components will be given below.

The backup tong 1 is located lowermost in the power tong construction 10, closest to the substratum or the drill floor, and is designed to enclose the upper end of a tubular (not shown), such as a drill pipe or casing. The upper end of the pipe has as known an internal threaded portion and is named the female part of a pipe joint. The backup tong 1 can by means of hydraulic/mechanical means grip around the pipe via gripping jaws and retain the pipe against rotation. The backup tong 1 has no ability to rotate the pipe.

The torque tong 2 is located above the backup tong 1 in the power tong construction 10. The torque tong 2 is also able to grip around a pipe close to a pipe joint, i.e. the lower end of a pipe that is vertically depending from an elevator or a pipe handler apparatus. The lower end of the pipe has a portion with external threads and is described as the male part of a pipe joint. The torque tong 2 grips the pipe with gripping jaws and fixes the pipe, at the same time as the tong, by activating motors, is able to perform rotation of the pipe for making up a predetermined torque, alternatively breaking out a pipe joint during disassembly of a pipe string that is unscrewed.

The spinner tong 3 is in turn located above the torque tong 2 in the power tong construction 10 and is primarily used to perform rapid screwing of the male part into the female part. The spinner tong 3 usually has three rollers with frictional surfaces that are engaged with the tubular somewhat above the pipe joint and the male part. When the external threads on the male part have entered the internal threads in the female part, the pipe is put into rotation by the spinner tong 3 via the rollers for rapid screwing of the male part into the female part that is stationary fixed by the backup tong 1. When the male threaded portion is ready screwed in by the spinner tong 3, the torque tong 2 will take over and make up correct predetermined torque within the pipe joint.

Reference is now made to FIG. 2 which clearly distinguish between the individual tongs in the power tong construction 10, and contributes to illustrate the translatory possibilities for the tongs. As shown the spinner tong 3 is located uppermost and is in the shown embodiment mounted to the torque tong 2 and follows the motions thereof. In addition, the spinner tong 3 can be driven individually and independently of the torque tong 2 in order to perform height adjustment relative to the torque tong 2. This can take place on an auxiliary frame 6 that is fixedly secured to the torque tong 2 and extends upwardly there from. The spinner tong 3 can be driven substantially vertically up and down along the auxiliary frame 6 by means of working cylinders, alternatively regular motor drive, hydraulic or electric.

The backup tong 2 can also be driven vertically up and down. In the shown embodiment the torque tong 2 is suspended in a "dolly" or trolley 7. The movements of the dolly 7 are guided by the main frame 4 via guides 4*a* along the sides of the main frame 4. The movements of the dolly 7 up and down are performed by a number of hydraulic cylinders 8 which acts between the main frame 4 and the dolly 7.

The backup tong 1 is as explained located lowermost and has normally a limited motional possibility in height. This takes place by means of two hydraulic cylinders that are fixed to the backup tong 1 and the main frame 4 and the cylinders are able to elevate and lower the backup tong 1 relative to the main frame 4.

As apparent from FIG. 2, the power tong construction 10 comprises a guide funnel 9. The guide funnel 9 is shown in a stand by position and can be folded down into operative position. The guide funnel 9 has as duty to perform guiding of a pipe end having a male part into a pipe end having a female part when a new pipe or pipe section is to be screwed together with the pipe string.

Figure 1:
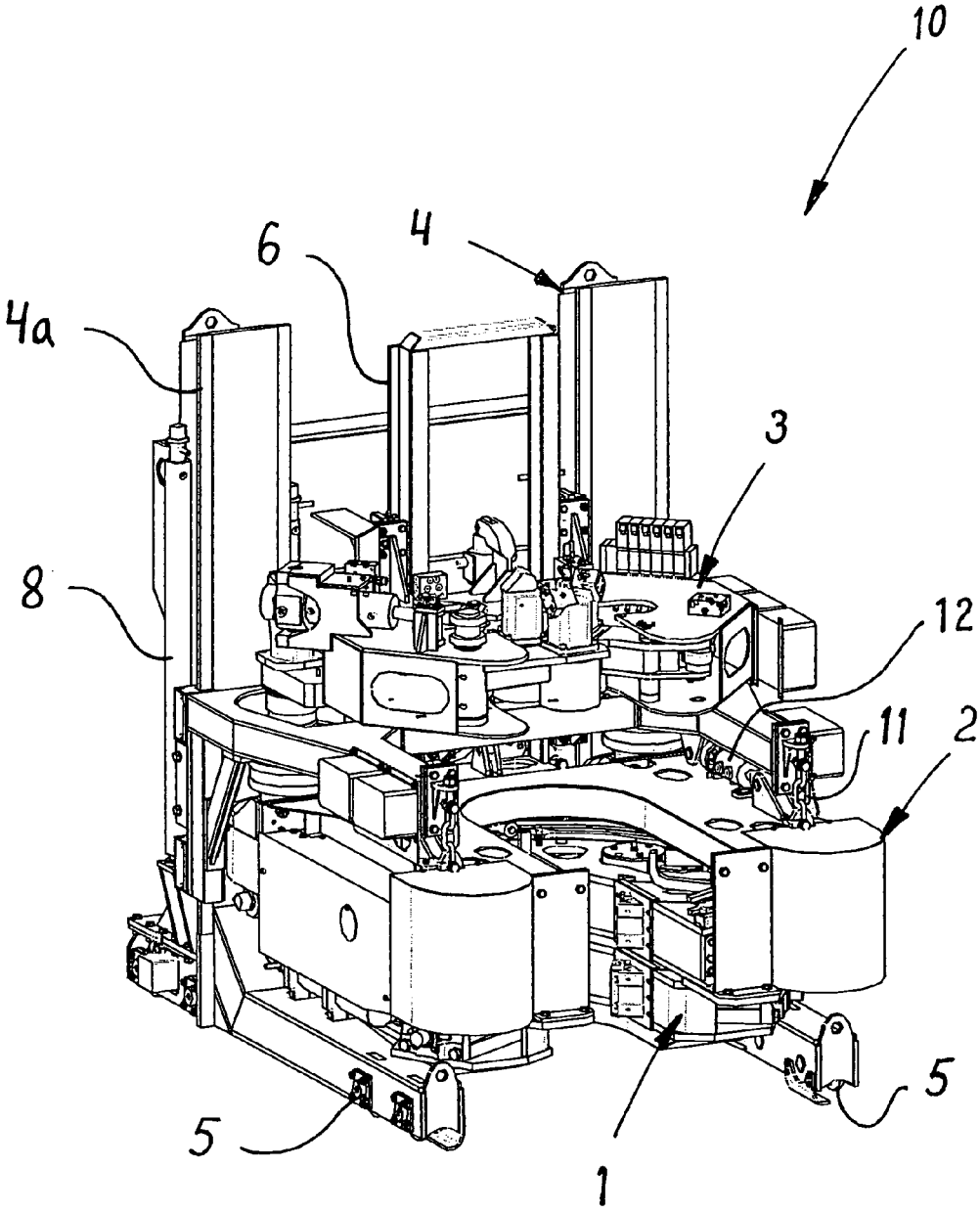
Figure 2:
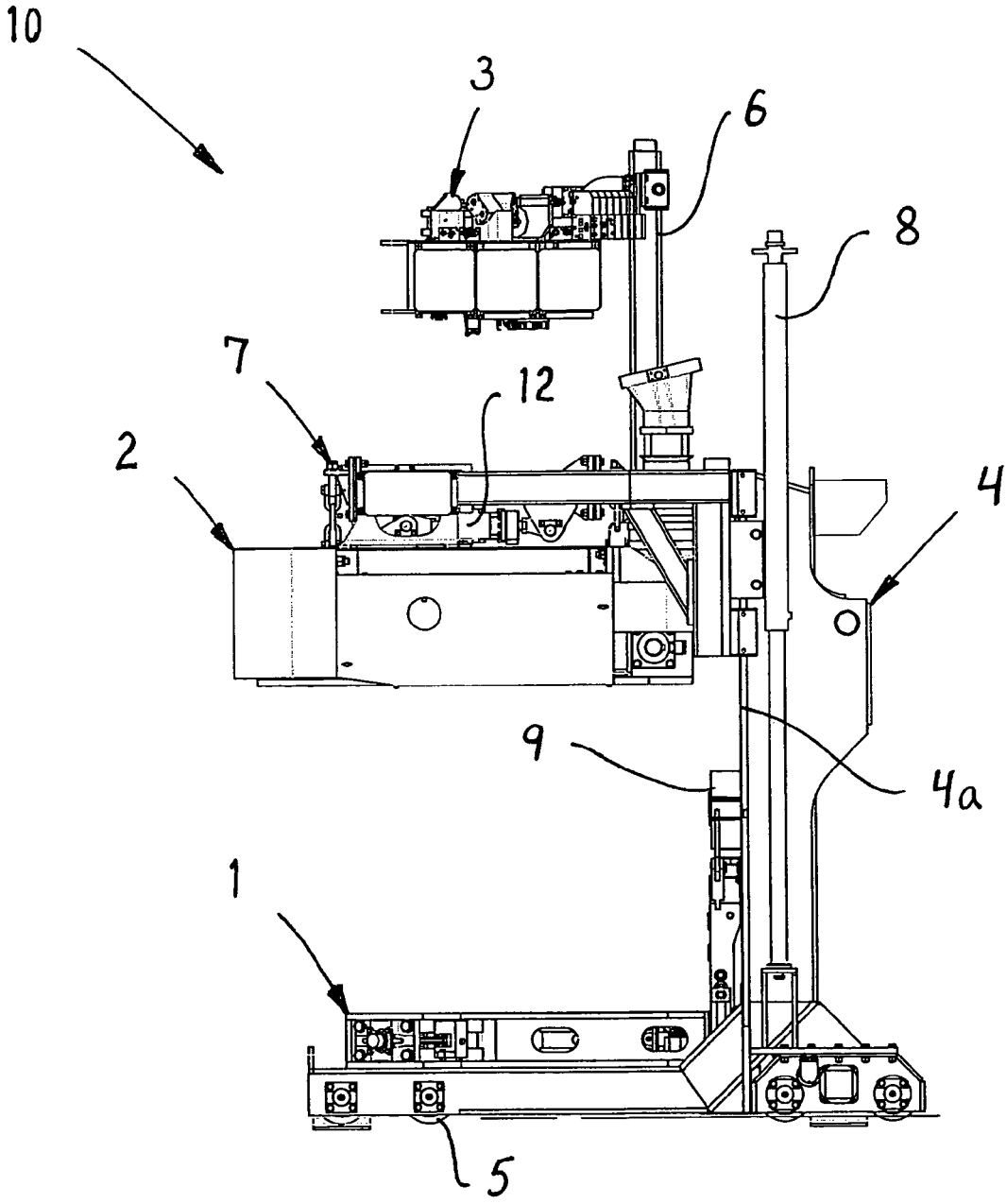
Figure 3:
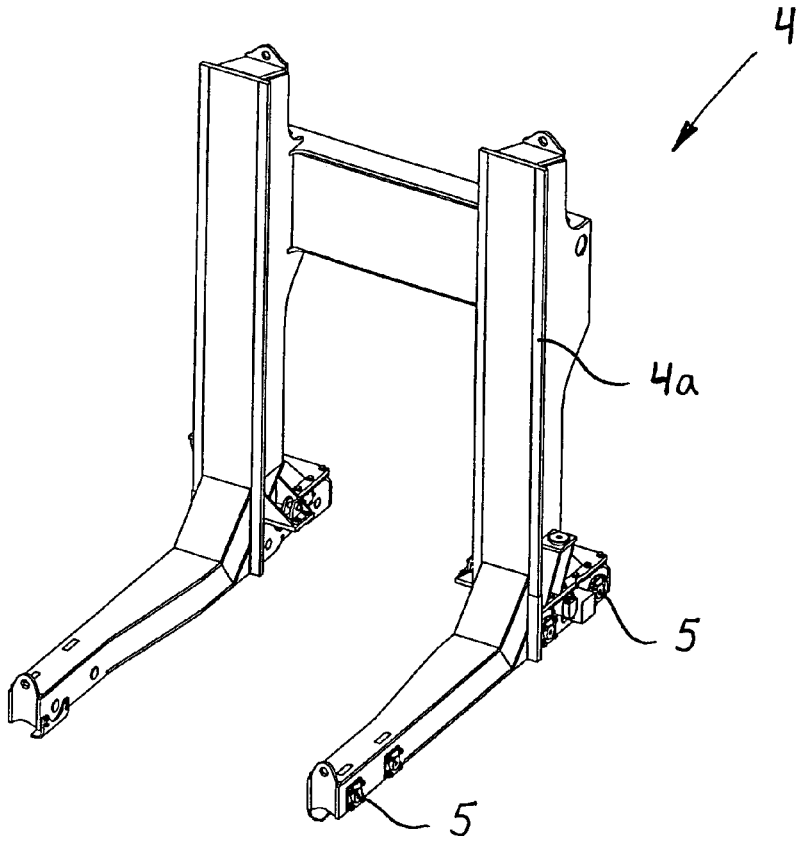
FIG. 3 shows in closer detail the main frame 4 as it appears without any tongs mounted thereon.
Figure 4:
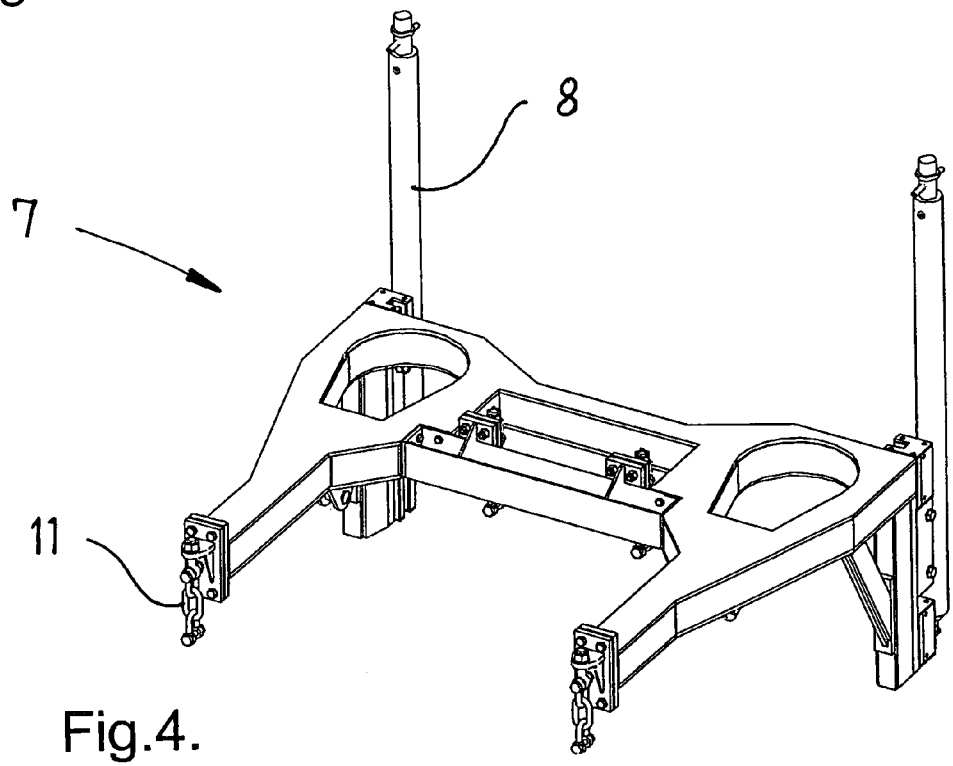
FIG. 4 shows in closer detail the dolly 7 as it appears without the torque tong 2 being suspended thereto.
Figure 5:
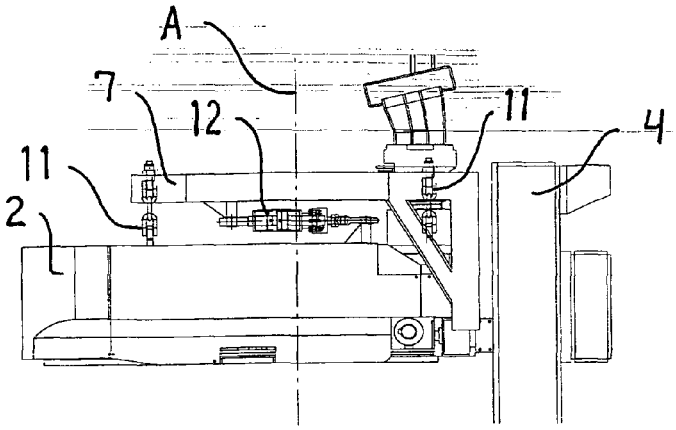

Reference is now made to FIG. 5 that is a somewhat more schematic presentation of the power tong construction 10 where the way the torque tong 2 is suspended in the dolly 7 is more clearly shown. It is to be understood that it is the dolly 7 that is guided along the main frame 4. The torque tong 2 is in turn loosely suspended in the dolly 7 via a number of chains 11. This contributes to that the torque tong can act "floating" in the tong plane, i.e. has a limited motional freedom in all directions in said plane. This floating function is to take care of and seek to annul or neutralize the introductory mentioned compulsory forces. This will be described in closer detail below with reference to FIGS. 6A and 6B.

In addition to be suspended in the chains 11, the torque tong 2 is also connected to the dolly 7 via two hydraulic cylinders 12. Such a cylinder 12 is closer illustrated in FIG. 6A. The two hydraulic cylinders 12 are arranged substantially horizontally and is located on each side of the centre axis A of a pipe string (not shown) that extend down through the tong construction 10. To obtain this floating function the two cylinders 12 need to have necessary degrees of freedom. And necessary degrees of freedom for the cylinders 12 will be the ability to swivel in the horizontal plane and vertical plane at the same time as there is a possibility for axial length variation of each cylinder 12. Typical possible length variation for this kind of cylinder 12 will be ±20 mm, without this to be considered as any limitation.

Figure 6A:
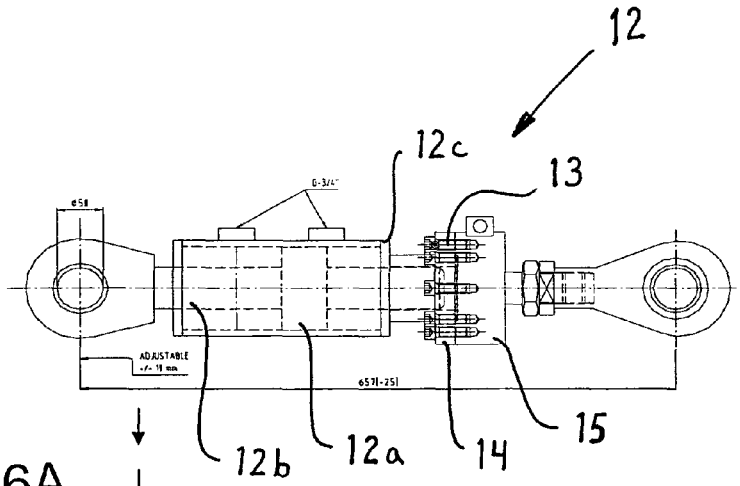

FIG. 6A shows in closer detail a working cylinder 12 combined with a number of load bolts 13. Each cylinder 12 has a piston 12*a* having the same area on each side. Each piston 12*a* is in turn secured to a through running piston rod 12*b*. Each cylinder 12 has a limited stroke and is filled with a hydraulic liquid. The load bolts 13 are mounted on the cylinder 12 via two flanges 14, 15 that form part of an extension of the cylinder 12 housing 12*c*. The load bolts 13 are in connection with strain gauges that are able to register the loads within a cylinder 12 which, in turn, is indicative for the applied torque by the tong.

Figure 6B:
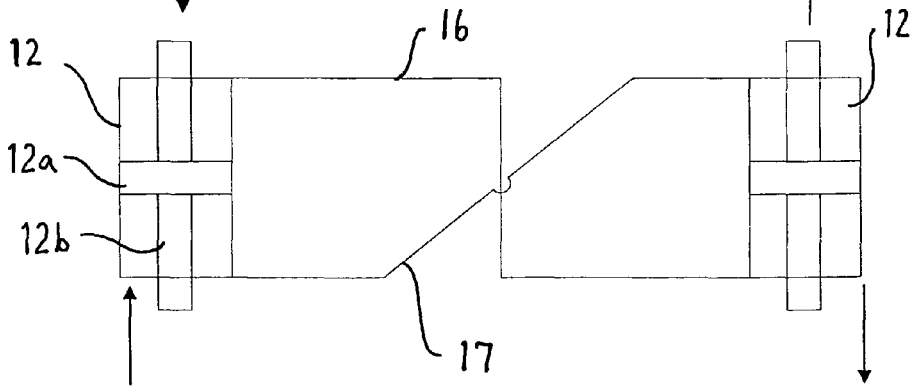

The schematic diagram in FIG. 6B illustrates that the working cylinder 12 is cross-connected via pipes 16, 17 that connect opposite ends. The pipes 16, 17 provide for communication of hydraulic liquid between the cylinders 12. When the torque tong 2 rotates and makes up torque, the hydraulic system is active, i.e. performs as a closed circuit. The hydraulic liquid mediates pressure/forces between the cylinders 12 and balances pressure differentials at the same time as it transfers pressure/forces. In this way reaction forces are taken up when the torque tong 2 makes up torque and this can in turn be read off. It is further to be understood that it is possible to preload both chambers with a pre-charge pressure in order to make the hydraulic liquid as stiff as possible. In addition, a safety valve is arranged to prevent possible excess pressure, for example due to rapid temperature changes, over load or similar.

Thus it is to be understood that the cylinders 12 will be locked when torque is applied by the tong, but if the cylinders 12 are applied equally directed forces, the cylinders 12 will be compressed or pulled out till the equally directed force ceases. This provides the desired result that no compulsory forces will appear, i.e. that possible compulsory forces are annulled or neutralized.

One example of this will be a backup tong that retains a female part of a pipe joint and the female part has an axis that defines pipe centre. If a backup tong that retains a male part of the pipe joint has its natural centre deviating from the centre of the female part before screwing together, forces between the male and female part will develop, when the male and female parts are united while the torque tong is rotated. The male and female part need to have the same centre axis in order to be joined. If the torque tong is not able to float freely, unidirectional forces will arise that tends to pull the two centre axes together. Since the torque tong rotates, these unidirected forces will also rotate. When they act sideways on the cylinders, this will result in that the torque tong swings out to the side such that the centre axes become coincident. When the deviation is in the longitudinal direction, this will generate a pressure increase in the same cylinder chamber for both cylinders. Since the cylinders are cross-connected the hydraulic liquid will move to opposite chamber in opposite cylinder, which is not under pressure. Since the two cylinders are equal the cylinder will move. Pressure generated by torque will be composed of oppositely directed forces, which entails that the pressure is equal for opposite chambers, but these are interconnected. These chambers thus are in equilibrium, and no motion is generated.

The invention claimed is:

1. A power tong construction, in particular designed to annul compulsory forces that may arise within the tong construction during makeup/breakout operations of pipe joints in a string of pipes, which power tong is constructed as a unit having a main frame carrying a torque tong and a backup tong, which main frame is normally located on a drill floor on board a floating vessel or on a fixed installation, and is translatory arranged in guide rails on the drill floor, and the torque tong is loosely suspended and "floatingly" arranged in the power tong construction, said power tong thereby having a limited freedom of motion in all directions in the horizontal plane and vertical plane, and means to counteract external rotation and annulment of compulsory forces comprising at least a pair of working cylinders articulated secured in each end to the torque tong and the main frame respectively, and the working cylinders are in fluid communication with each other via cross-connected pipe connections, characterized in that each working cylinder comprises an internal piston having equal area on both sides and a through running piston rod.

2. The power tong construction according to claim 1, characterized in that the means to counteract external rotation further includes a dolly, said dolly being vertically displaceable along the main frame and that the working cylinders are articulately secured in each end to the torque tong and the dolly respectively.

3. The power tong construction according to claim 1, characterized in that the "loose" suspension of the torque tong takes place by means of a number of chains depending down from the main frame/dolly and provide degrees of freedom in the tong plane.

4. The power tong construction according to claim 1, characterized in that the working cylinders form a force couple during a making up operation where the working cylinders include load bolts that are able to provide a signal indicative for the applied torque by the torque tong.

5. The power tong construction according to claim 1 , characterized in that the tong construction further comprises a spinner tong located above the torque tong.

6. The power tong construction according to claim 5, characterized in that the spinner tong is mounted on the torque tong and is displaced together therewith.

7. The power tong construction according to claim 6, characterized in that the spinner tong is mounted to an auxiliary frame which in turn is mounted to the torque tong and the spinner tong is in turn adjustable in height relative to the torque tong.

8. The power tong construction according to claim 1, characterized in that the power tong construction includes a guide funnel that is displaceable in and out of position to guide a pipe end having a male part into a pipe end having a female part.

* * * * *